US009376249B2

(12) United States Patent
Steele et al.

(10) Patent No.: US 9,376,249 B2
(45) Date of Patent: Jun. 28, 2016

(54) SANITARY DISPENSING PACKAGE

(75) Inventors: Mark Steele, New Prague, MN (US); Greg Melchoir, Green Bay, WI (US)

(73) Assignee: Mark Steele, New Prague, MN (US)

( * ) Notice: Subject to any disclaimer, the term of this patent is extended or adjusted under 35 U.S.C. 154(b) by 0 days.

(21) Appl. No.: 13/543,475

(22) Filed: Jul. 6, 2012

(65) Prior Publication Data

US 2013/0037563 A1 Feb. 14, 2013

Related U.S. Application Data

(60) Provisional application No. 61/505,865, filed on Jul. 8, 2011.

(51) Int. Cl.

| | |
|---|---|
| ***B67D 3/00*** | (2006.01) |
| ***B65D 75/58*** | (2006.01) |
| ***B65D 47/20*** | (2006.01) |
| ***B65D 47/06*** | (2006.01) |
| ***B65D 47/10*** | (2006.01) |
| ***B65D 47/26*** | (2006.01) |

(Continued)

(52) U.S. Cl.

CPC ..... *B65D 75/5883* (2013.01); *B65D 47/063* (2013.01); *B65D 47/066* (2013.01); *B65D 47/10* (2013.01); *B65D 47/2043* (2013.01); *B65D 47/26* (2013.01); *B65D 47/36* (2013.01); *B65D 75/008* (2013.01); *B65D 75/5811* (2013.01)

(58) Field of Classification Search

CPC ..... B65D 47/10; B65D 47/26; B65D 47/061; B65D 47/063; B65D 47/066; B65D 47/2043; B65D 47/36; B65D 51/18; B65D 47/265; B65D 35/12; B65D 75/5883; B65D 75/008; B65D 75/5811

USPC ..... 222/1, 92, 107, 527–532, 534–539, 222/541.1, 541.5, 541.6, 541.9, 153.06

See application file for complete search history.

(56) References Cited

U.S. PATENT DOCUMENTS

| | | | | |
|---|---|---|---|---|
| 3,093,273 | A * | 6/1963 | Borah | 222/527 |
| 3,133,575 | A | 5/1964 | Slemmons | |
| 3,224,640 | A | 12/1965 | Schneider et al. | |

(Continued)

FOREIGN PATENT DOCUMENTS

| | | | |
|---|---|---|---|
| CN | 1333727 | A | 1/2002 |
| CN | 101301941 | A | 11/2008 |

(Continued)

OTHER PUBLICATIONS 201280039291.4 (CN) application Office Action with English translation summary, Jan. 14, 2015.

(Continued)

*Primary Examiner* — Frederick C Nicolas

(74) *Attorney, Agent, or Firm* — Skaar Ulbrich Macari, P.A.

(57) ABSTRACT

A package having a sanitary dispenser is depicted and described. The package generally includes a dispenser that is sealed from environmental contaminants by a feature or portion of the package. The sealed dispenser portion of the package is accessed prior to use and the user is able to access the contents of the package through the sanitary dispenser. The dispenser may be inverted prior to use and deployed prior to use. A frangible portion may be provided to the dispenser. The dispenser may be re-sealable in the package. A straw may further be provided to the dispenser and be deployable by the user for access to the package contents.

16 Claims, 6 Drawing Sheets

(51) Int. Cl.

| | |
|---|---|
| ***B65D 47/36*** | (2006.01) |
| ***B65D 75/00*** | (2006.01) |

(56) References Cited

U.S. PATENT DOCUMENTS

| | | | | | |
|---|---|---|---|---|---|
| 3,367,380 | A | | 2/1968 | Dickey | |
| 3,419,137 | A | | 12/1968 | Walck, III | |
| 3,559,847 | A | * | 2/1971 | Goodrich | 222/107 |
| 3,642,189 | A | | 2/1972 | Widenback | |
| 4,209,115 | A | | 6/1980 | Stahl | |
| 4,640,425 | A | * | 2/1987 | Cabernoch | 215/11.6 |
| 4,657,792 | A | * | 4/1987 | Ausnit | 428/35.5 |
| 4,711,359 | A | | 12/1987 | White et al. | |
| 4,732,299 | A | | 3/1988 | Hoyt | |
| 4,830,205 | A | * | 5/1989 | Hammond et al. | 215/11.3 |
| 4,848,601 | A | * | 7/1989 | Reil | 222/528 |
| 4,887,912 | A | | 12/1989 | Stumpf | |
| 5,005,734 | A | * | 4/1991 | Van Gordon et al. | 222/107 |
| D331,348 | S | * | 12/1992 | Park | D9/434 |
| 5,314,088 | A | * | 5/1994 | Heuberger et al. | 229/117.3 |
| 5,358,154 | A | | 10/1994 | Halm | |
| 5,743,443 | A | | 4/1998 | Hins | |
| 5,823,383 | A | | 10/1998 | Hins | |
| 5,839,614 | A | | 11/1998 | Brown | |
| 6,050,451 | A | * | 4/2000 | Hess et al. | 222/92 |
| 6,131,806 | A | | 10/2000 | Hess, III et al. | |
| 6,138,849 | A | | 10/2000 | Roemer et al. | |
| 6,164,822 | A | | 12/2000 | Beer | |
| 6,405,901 | B1 | | 6/2002 | Schantz et al. | |
| 6,427,874 | B2 | | 8/2002 | Brown et al. | |
| 6,637,623 | B2 | * | 10/2003 | Muise et al. | 222/105 |
| 6,752,264 | B2 | | 6/2004 | Versluys | |
| 2005/0109796 | A1 | | 5/2005 | Bourque et al. | |
| 2007/0278114 | A1 | | 12/2007 | Kane et al. | |
| 2010/0038386 | A1 | * | 2/2010 | Pritchard | 222/522 |

FOREIGN PATENT DOCUMENTS

| | | | |
|---|---|---|---|
| DE | 10340099 | A1 | 3/2005 |
| EP | 1145983 | A2 | 10/2001 |
| JP | 2004359258 | A | 12/2004 |
| JP | 2006176138 | A | 7/2006 |
| JP | 2007308151 | A | 11/2007 |
| WO | 9954217 | | 10/1999 |
| WO | 0151367 | | 7/2001 |

OTHER PUBLICATIONS

PCT/US2012/045862 application International Preliminary Report on Patentability, Jan. 14, 2014.

PCT/US2012/045862 application International Search Report and Written Opinion, Dec. 6, 2012.

* cited by examiner

SANITARY DISPENSING PACKAGE

PRIORITY

This Application claims priority to and the benefit of U.S. Provisional Application No. 61/505,865, filed Jul. 8, 2011, which is hereby incorporated herein by reference in its entirety.

FIELD

The present invention relates generally to flexible packaging and, more particularly, to packages, and methods for forming and using packages, having sanitary dispensing features provided to the package.

BACKGROUND

Flexible packages are used for containing a wide variety of flowable contents, both solid and liquid, such as beverages, lawn products and food products. More and more packages, including flexible packages, are being used for the containment and or dispensing of food or medical products. The inside area of the packages can be maintained in a sanitary or sterile state. However, the outside of the packages are non-sanitary and non-sterile. Thus, for packages that are being used multiple times, such as a package with a re-closeable dispensing device, the dispensing device, once opened for dispensing can become contaminated and also communicate the contamination to the inside of the package. Further, the dispensing portion, such as the portion used for dispensing drinks or other flowable contents to a user's mouth or a receptacle, is generally exposed or otherwise in contact with outside or undesirable contaminants (unsanitary). Thus, there is a need for a flexible package that substantially solves the above-referenced problems with conventional package designs, configurations, and manufacturing methods.

SUMMARY

The present invention addresses certain problems facing flexible packages and the packaging industry. Embodiments of the present invention are directed to a flexible package having a dispensing device that is protectable within an interior sterile and/or sanitary area of the package. The dispensing device can be actuated in a variety of ways and configurations, as disclosed herein and equivalents thereof.

In certain example embodiments the package generally includes a dispenser that is sealed from environmental contaminants by a feature or portion of the package. The sealed dispenser portion of the package is accessed prior to use and the user is able to access the contents of the package through the sanitary dispenser. The dispenser may be inverted prior to use and deployed prior to use. A frangible portion may be provided to the dispenser. The dispenser may be re-sealable in the package. A straw may further be provided to the dispenser and be deployable by the user for access to the package contents.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
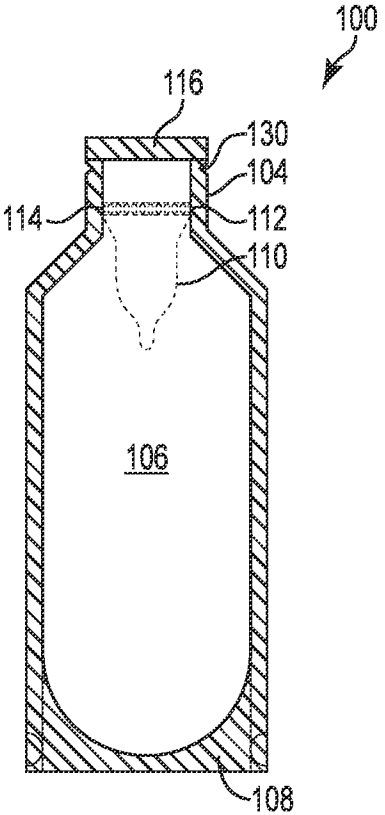
FIG. 1 is a front view of a package in accordance with a first example embodiment of the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims. For illustrative purposes, cross-hatching, dashing or shading in the figures is provided to demonstrate sealed portions and/or integrated regions or devices for the package.

DETAILED DESCRIPTION

In the following descriptions, the present invention will be explained with reference to example embodiments thereof. However, these embodiments are not intended to limit the present invention to any specific example, embodiment, environment, applications or particular implementations described in these embodiments. Therefore, description of these embodiments is only for purpose of illustration rather than to limit the present invention. It should be appreciated that, in the following embodiments and the attached drawings, elements unrelated to the present invention are omitted from depiction; and dimensional relationships among individual elements in the attached drawings are illustrated only for ease of understanding, but not to limit the actual scale.

References to "top," "bottom," "front," "back" and the like are for illustrative purposes only and are not meant to limit the scope of the disclosed invention. For instance, placing a nozzle on the "top" could be just as easily employed in the side or bottom portions of the package.

Referring to FIGS. 1-4, a first example embodiment is shown that is particularly adapted to allowing a user to drink fluids directly from the pouch. The package 100 comprises a sanitary pouch that can be used in non-sanitary areas which could have made contact with many types of germs or other contaminants during the shipping and storing process. The inside of the pouch will remain sanitary during this time, so having a nozzle or nipple stored inside the pouch that can be removed or pushed out once the pouch is opened, will allow the user to put the clean nozzle or nipple in their mouth for dispensing the product without the germs from the outside of the pouch contacting them.

The flexible package 100 comprises a front panel 102 and back panel 103 (visible in FIG. 13) defining an interior compartment 106 accessible through an access opening. The edges of the front 102 and back 103 panels are sealed together. Reference 104 generally indicates the sealed portions, rather than being an indicia of cross-sectioning.

One or more of the portions of the package 100 may also be gusseted. Placing a gusset 108 on the bottom also provides the product with the ability to stand up on its own. Other gusset placements, such as on a side or top can also be provided without departing from the scope of the invention.

A spout, nozzle, dispenser or fitment 110, of any suitable shape or size, is provided to a portion of the neck 112 at the top of the interior compartment 106. However, it is understood that the dispenser 110 could be located in various other positions and still be within the scope of the invention. The dispenser 110 in this embodiment is initially in an inverted state about the inversion line 114 before the package is opened by a user. In addition, a top seal 116 is provided opposite the inverted dispenser to keep the entire dispenser in a sanitary and/or sterile environment. A frangible tip 118, or other dispenser outlet aperture seal device, is provided to the dispenser to keep the contents from exiting the dispenser when pressure is applied to the package and nozzle.

Figure 23:
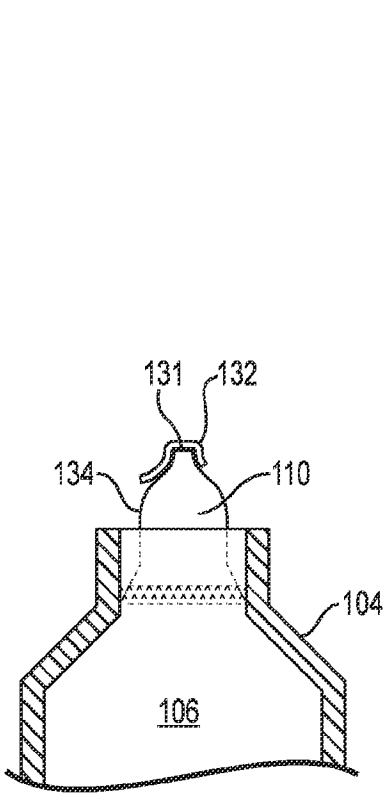
FIG. 23 is a partial front view of a package in accordance with an additional example embodiment of the present invention.

Alternatively, the tip 118 of the dispenser may comprise a peel seal film or other removable portion where the user, instead of tearing or breaking off the tip, would peal the two films apart that make up the funnel tip. In another alternative, referring to FIG. 23, the tip seal 118 can be configured as a flap 132 extending over the aperture 131 in the tip to seal the aperture and then be tacked down to the tip outer surface 134. The folded portion 132 is lifted to open the aperture. This way there is nothing that would be removed to cause chocking. Also, the flap 132 can be used to reseal the tip.

The tip can also be provided with a reclosure device 119, such as a zipper or other resealable seal.

The dispenser 110 can be formed in a variety of ways without departing from the invention scope. In one example embodiment, a thin material or film such as a polyethylene forms a funnel, nozzle or nipple, that would tuck inside the pouch as the pouch is made. In this case, the user would tear off the top seal of the pouch or package, and then by squeezing the pouch, would cause the nozzle or nipple to press outside of the pouch (turning itself inside out) and protrude outside the non-sanitary area of the pouch.

Figure 2:
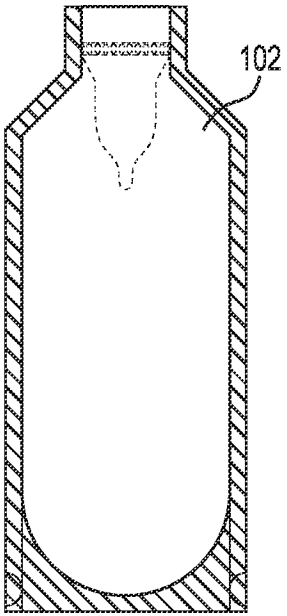
FIG. 2 is another front view of a package in accordance with a first example embodiment of the present invention.
Figure 3:
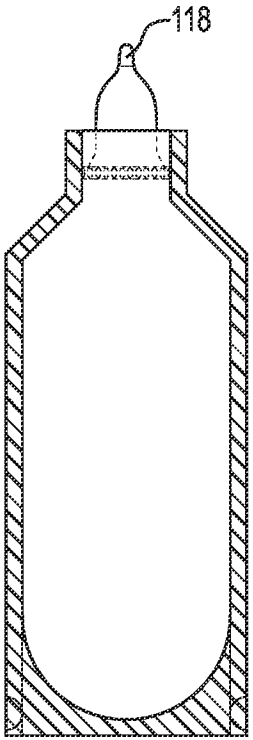
FIG. 3 is another front view of a package in accordance with a first example embodiment of the present invention.
Figure 4:
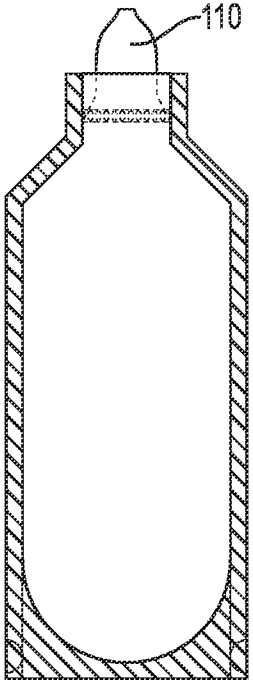
FIG. 4 is another front view of a package in accordance with a first example embodiment of the present invention.
Figure 8:
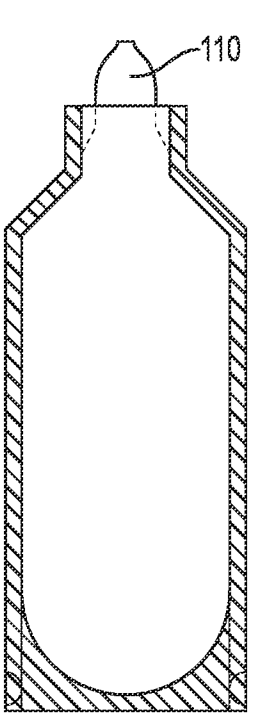
FIG. 8 is another front view of a package in accordance with a second example embodiment of the present invention.
Figure 7:
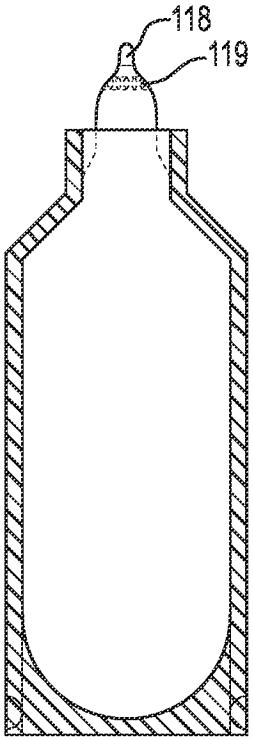
FIG. 7 is another front view of a package in accordance with a second example embodiment of the present invention.
Figure 6:
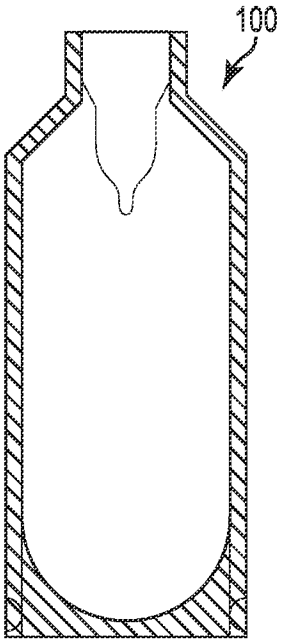
FIG. 6 is another front view of a package in accordance with a second example embodiment of the present invention.
Figure 5:
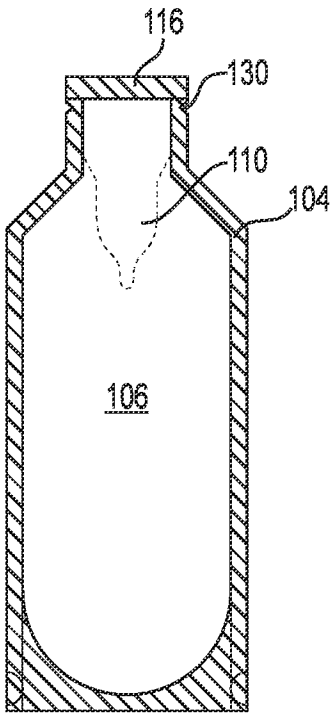
FIG. 5 is a front view of a package in accordance with a second example embodiment of the present invention.

In use, the top seal 116 is removed as shown in FIG. 2. The package is then squeezed by the user to extend the dispenser as shown in FIG. 3. Next, the frangible tip or seal 118 on the dispenser is removed. The contents of the package can then be accessed by the user. Thus, for example, a user is able to put the clean dispenser nozzle or nipple in their mouth for dispensing the product without the germs from the outside of the pouch contacting them. The top seal can also be re-closable or zipper-type so that the user can re-invert the nipple and re-close the top seal after dispensing as discussed with respect to FIG. 22, thereby minimizing the potential for contaminants to contaminate the dispenser prior to a subsequent use.

Referring to FIGS. 5-8, a second example embodiment is shown. In this embodiment, the dispenser 110 is sealed into the package. It operates in the same manner as the first example embodiment.

Figure 11:
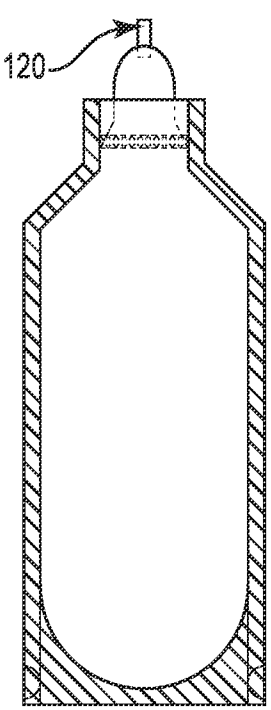
FIG. 11 is another front view of a package in accordance with a third example embodiment of the present invention.
Figure 10:
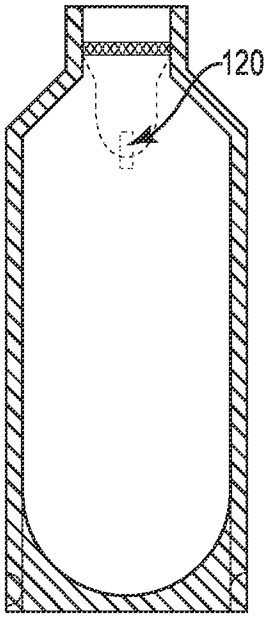
FIG. 10 is another front view of a package in accordance with a third example embodiment of the present invention.
Figure 9:
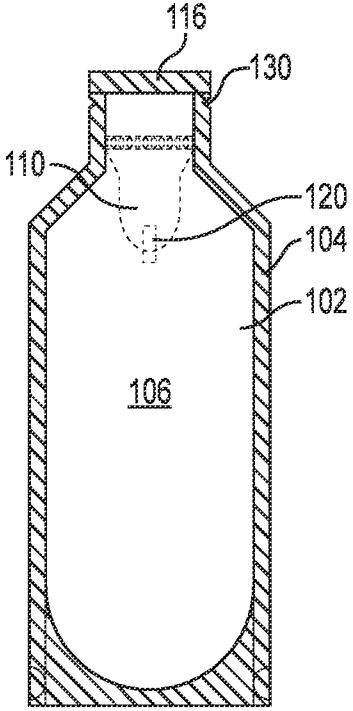
FIG. 9 is a front view of a package in accordance with a third example embodiment of the present invention.

Referring to the third example embodiment shown in FIGS. 9-11, the dispenser 110 is provided with a dispensing tube or straw 120. The straw 120 can be recessed inside of a frangible tip, or, as shown in FIGS. 9-11, it can be configured and located to perform the same function as the frangible tip. For example, the straw 120 may include a closed end that can be removed or ruptured by the user. The length of the straw is variable depending on the application and preferences of the user or package maker. The straw can extend into the dispenser 110 and be slidably extendable outwardly from the dispenser as show in FIG. 11. This can be accomplished by the user's teeth, hands, or other suitable means, including the application of pressure to the body of the pouch by the user to extend the straw. A flange or seal, not shown, on the inner end of the straw can be provided to retain or prevent the straw from ejecting from the dispenser. Operation is otherwise similar to the previous embodiments.

The straw 120 can be rigid, semi-rigid or flexible. The straw 120 can also be used as a conduit for filling the pouch, wherein after the straw is pushed in and then the top sealed. The straw can also be configured for one-way flow to prevent leakage.

Figures 12, 13, 14, 15:
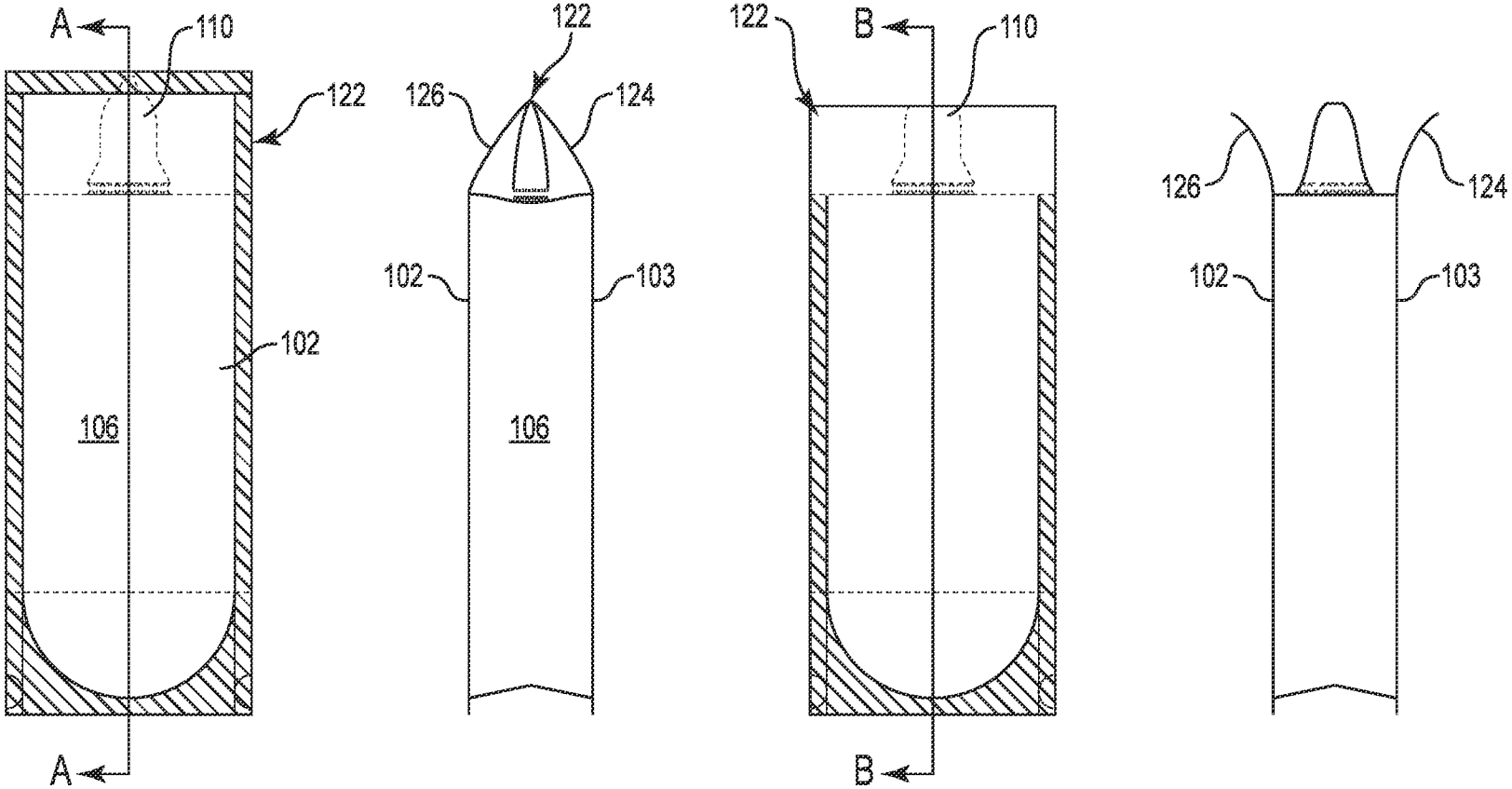
FIG. 12 is a front view of a package in accordance with a fourth example embodiment of the present invention.
FIG. 13 is a cross-sectional side view of a package in accordance with a fourth example embodiment of the present invention.
FIG. 14 is another front view of a package in accordance with a fourth example embodiment of the present invention.
FIG. 15 is another cross-sectional side view of a package in accordance with a fourth example embodiment of the present invention.
Figure 19:
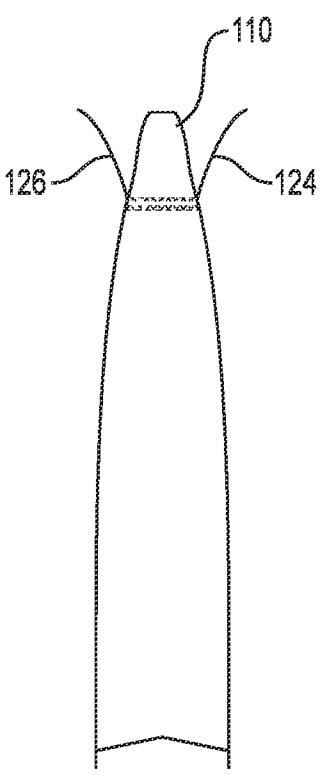
FIG. 19 is another cross-sectional side view of a package in accordance with a fifth example embodiment of the present invention.
Figure 18:
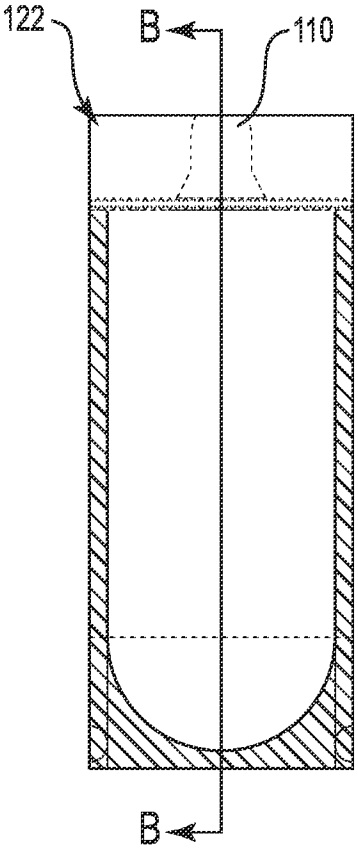
FIG. 18 is another front view of a package in accordance with a fifth example embodiment of the present invention.
Figure 17:
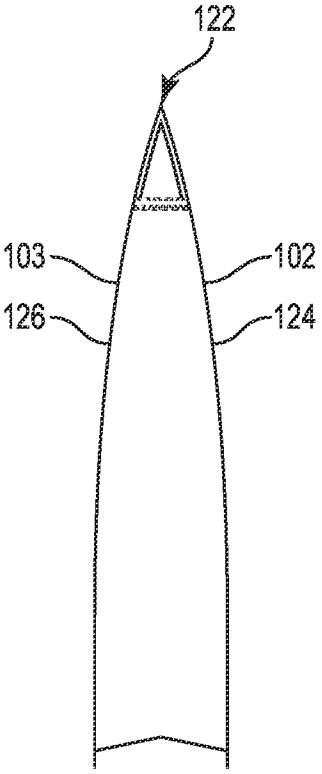
FIG. 17 is a cross-sectional side view of a package in accordance with a fifth example embodiment of the present invention.
Figure 16:
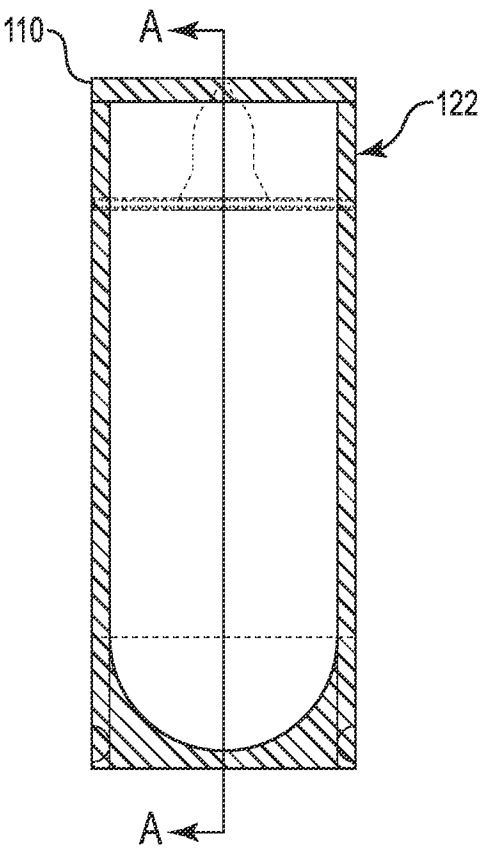
FIG. 16 is a front view of a package in accordance with a fifth example embodiment of the present invention.

Referring to FIGS. 12-15, a fourth example embodiment of a sanitary dispensing package is shown. Here, the dispenser or nozzle 110 is disposed inside a top gusseted portion 122 of the package. First 124 and second 126 panels form the gusseted portion 122, which protects the dispenser 110 from outside contaminants until the user tears open the top seal formed by the panels 124 and 126. Then the panels are peeled back, or completely removed, to expose the dispenser as shown in FIGS. 14-15. The dispenser 110 and top gusset section 122 can also be configured so that the act of opening the top panels also removes the top of the dispenser.

This embodiment allows the dispenser to be in a deployed orientation (i.e. not-inverted) while still being sealed against contaminants.

In an alternative arrangement as shown in the fifth example embodiment of FIGS. 16-19, a top gusset is not provided.

Instead, a peel seal film with the dispenser can be utilized. The front and back panels 124 and 126 are extended higher beyond the nozzle and seal the nozzle facing up within the front and back panels. In this embodiment, the user would tear off the top seal 116 and peel back the front 124 and back 126 panels down to the base of the nozzle 110 (where the side seals would then be destruct seals) and then dispense the product from the container or package.

Figure 22:
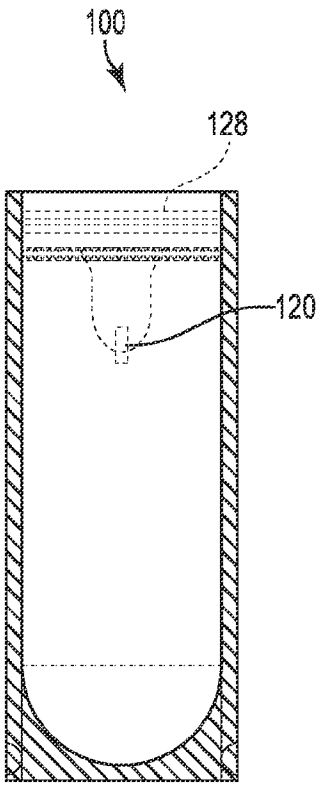
FIG. 22 is another front view of a package in accordance with a sixth example embodiment of the present invention.
Figure 21:
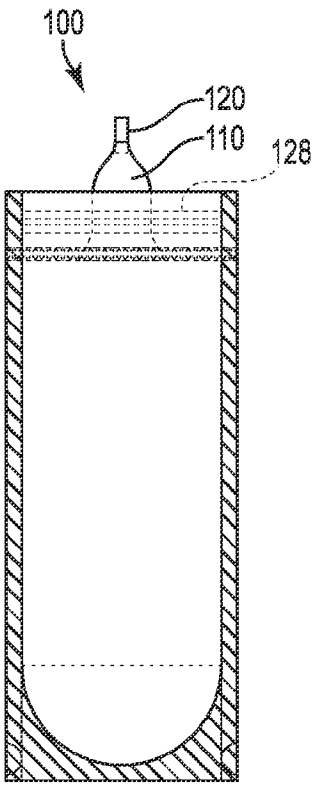
FIG. 21 is another front view of a package in accordance with a sixth example embodiment of the present invention.
Figure 20:
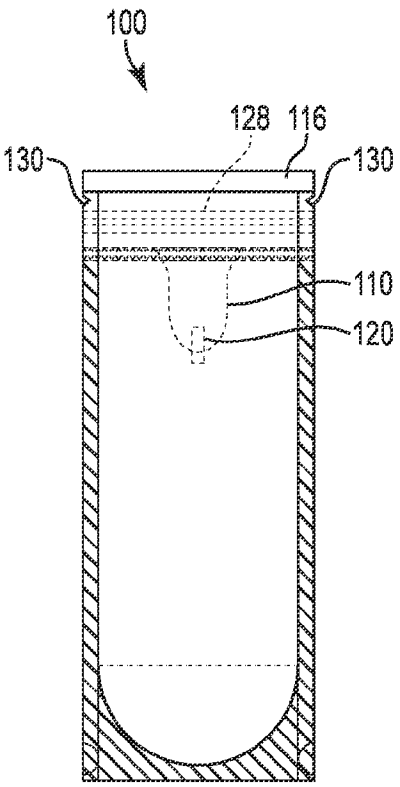
FIG. 20 is a front view of a package in accordance with a sixth example embodiment of the present invention.

Referring to FIGS. 20-22, a sixth example embodiment of the invention is shown. This embodiment comprises a flexible stand-up pouch 100 with a recloseable device 128, such as a zipper or like feature. The recloseable device 128 can be included along a portion of the package, e.g., above the nozzle 110. Once the user opens the package by removing or tearing away a portion of the top 116 and opens the exposed recloseable device 128, they can apply pressure or otherwise invert the nozzle 110 to provide the dispensing funnel or spout outside of the package 100. Once the amount of product desired has been dispensed, the user can then invert or otherwise return the nozzle 110 back within the package 100 area and close or seal the device 128, as shown in FIG. 22. As such, the nozzle 110 will remain in a contained and sanitary environment within the closed package 100 when not in use, and moved to a position outside of the package 100. When the user wishes to dispense more product from the package 100, they can again open the device 128 and repeat the steps described.

A top seal 116 can be provided that the user removes before a first use. A tear notch 130 can be provided to facilitate removal of the top seal 116.

In some applications, such as with some medical applications, the product contained in the packages according the invention can be sterilized while in the package. Sterilization can also be done again once the pouch has been used the first time and will re-sterilize the product and flaps after the flaps have been tucked back into the pouch and the pouch has been reclosed.

The package according to the invention can include packages constructed, in whole or in part, of flexible, rigid, semi-rigid, or semi-flexible materials or panels. The construction of the package is generally described in U.S. patent application Ser. No. 12/400,304, which is hereby incorporated by reference in its entirety. Briefly, the package panel portions are generally constructed of flexible sheet material such as polyethylene, polyester, metal foil, polypropylene, or polyethylenes or polypropylenes laminated with other materials such as nylon, polyester, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The present invention in certain embodiments permits the flexible package to be made using less expensive or cheaper materials than would otherwise be necessary.

The nozzle can be formed from the same material as the panels. Alternatively, it can be formed of a more rigid material such as rubber or plastic. In one embodiment, the nozzle can be formed of molded rubber that retains its shape but allows the nozzle to be inverted and extended repeatedly. A mixture of materials can also be used, such as a rigid nozzle on a flexible base. The nozzle can be formed using a variety of processes, including extruding, thermal forming, stamping and molding.

The package 100 and its portions can be formed to provide a stand-up pouch, pre-made pouch, bag-top, one formed and filled on a "form-fill-seal" (e.g., vertical, horizontal, etc.) machine, thermoforming machine, and other known package designs and configurations. Other known package designs and packaging techniques and features can be adapted to incorporate or form the configuration of the present invention as well. The fitment or dispenser 110 can be provided to the package 100 during the machining or formation process, or pre-applied to a section of material or web prior to package formation. The dispenser can also be post-applied to a pre-made package.

Embodiments employing seals can utilize heat seals, adhesive bonding, and various other known sealing techniques. Further, various tearable or removable portions of seals or package portions can include notches, scoring, perforations or the like to facilitate removal.

Various figures and descriptions disclose features and accessories. However, it must be noted that these features are merely illustrative in nature and may be placed in varying locations and under varying configurations and shapes, and still be consistent with the present invention. Various regions of the package can include a handle portion, access devices (e.g., re-closeable zipper devices), and the like.

In addition, the shape and configuration for the panel portions are also merely illustrative and can be altered without deviating from the spirit and scope of the present invention. Any of the panel portions, or selected regions thereof, can include various aesthetic and functional graphics, such as logos, instructions, advertising, bar codes, and the like. These graphics can run transverse, parallel, or even in a diagonal orientation to the longitudinal panel edges discussed herein.

The invention is not intended to be limited to any specific contents to be held therein unless explicitly stated in a given claim. The contents of the package can include a wide variety of flowable products, including liquids, solids, gases, and mixtures thereof. The interior compartment can also optionally be pressurized or placed in a vacuum state.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed before, between or after any of the various steps of the method. In addition the steps of the method can be performed in any order without departing from the scope of the invention. Moreover, features or aspects of various example embodiments may be mixed and matched (even if such combination is not explicitly described herein) without departing from the scope of the invention.

What is claimed is:

1. A flexible package, comprising:

a first panel;

a second panel sealed to the first panel and defining an interior compartment therebetween to contain flowable products, and a neck portion having a top region;

a bottom portion;

a top seal disposed at the top region of the neck; and a dispenser disposed in the neck along an inversion line defined in the neck, the dispenser having a frangible distal tip movable between a recessed position and a dispensing position, the recessed position being at least partially within the compartment and sealed from contaminants by the top seal such that the distal tip extends inward toward the bottom portion, the dispensing position at least partially extending outwardly from the neck portion such that the distal tip extends outward away from the bottom portion in a direction opposite the recessed position, with a portion of the frangible distal tip being removable to access the flowable products.

2. The flexible package of claim 1, wherein the neck portion includes a tear notch to facilitate removal of the top seal.

3. The flexible package of claim 1, further comprising a gusset disposed between a portion of the first panel and the second panel.

4. The flexible package of claim 1, further comprising a recloseable device provided to the package.

5. The flexible package of claim 1, wherein the dispenser includes an extendable dispensing tube disposed therein.

6. The flexible package of claim 5, wherein the dispensing tube comprises a retaining flange on an end thereof.

7. The flexible package of claim 1, wherein the dispenser is constructed at least in part of a flexible film material.

8. A method of dispensing flowable products, the method comprising:

providing a package having a first panel, a second panel, and a bottom portion, wherein at least the first and second panels define an internal compartment;

opening a top seal of the package to access a dispenser, wherein the dispenser includes a distal tip initially extending within the internal compartment toward the bottom portion in an initial position;

inverting an orientation of the dispenser such that the distal tip extends away from the bottom portion in a direction opposite the initial position; and removing a portion of the dispenser to access the flowable products contained in the flexible package.

9. The method of claim 8, further comprising extending a dispensing tube from the dispenser.

10. The method of claim 8, further comprising re-inverting the dispenser and re-closing the top seal.

11. The method of claim 8, wherein the dispenser is constructed at least in part of a flexible film material.

12. The method of claim 8, wherein inverting the orientation of the dispenser is facilitated by applying pressure to at least one of the first or second panels.

13. The method of claim 8, wherein the dispenser includes a frangible tip extending from the dispenser.

14. The method of claim 8, wherein at least the first panel includes a tear notch.

15. The method of claim 8, wherein the package includes a gusset disposed between a portion of the first panel and the second panel.

16. The method of claim 8, wherein the package includes a recloseable device.

* * * * *